US008474152B2

(12) United States Patent
Bellinger et al.

(10) Patent No.: US 8,474,152 B2
(45) Date of Patent: Jul. 2, 2013

(54) METHOD TO DETECT AN EMPTY LOAD IN A CLOTHES DRYER

(75) Inventors: Ryan R. Bellinger, Saint Joseph, MI (US); David M. Williams, Saint Joseph, MI (US); Christopher J. Woerdehoff, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 453 days.

(21) Appl. No.: 12/900,571

(22) Filed: Oct. 8, 2010

(65) Prior Publication Data

US 2012/0084996 A1 Apr. 12, 2012

(51) Int. Cl.

| | |
|---|---|
| ***F26B 3/00*** | (2006.01) |
| ***F26B 3/02*** | (2006.01) |
| ***F26B 3/04*** | (2006.01) |
| ***F26B 3/06*** | (2006.01) |
| ***F26B 3/14*** | (2006.01) |

(52) U.S. Cl.
USPC ..... 34/493; 34/491; 34/496; 34/497

(58) Field of Classification Search
USPC ..... 34/446, 471, 491, 493, 496, 497; 702/1
See application file for complete search history.

(56) References Cited

U.S. PATENT DOCUMENTS

| | | | | |
|---|---|---|---|---|
| 3,218,730 | A * | 11/1965 | Menk et al. | 34/527 |
| 5,347,727 | A | 9/1994 | Kim | |
| 5,570,520 | A | 11/1996 | Huffington | |
| 5,649,372 | A | 7/1997 | Souza | |
| 6,047,486 | A | 4/2000 | Reck et al. | |
| 6,751,888 | B2 | 6/2004 | Lueckenbach | |
| 7,080,464 | B1 * | 7/2006 | Tarnowski et al. | 34/493 |
| 7,594,343 | B2 * | 9/2009 | Woerdehoff et al. | 34/491 |
| 8,015,726 | B2 * | 9/2011 | Carow et al. | 34/381 |
| 2006/0272177 | A1 | 12/2006 | Pezier et al. | |
| 2007/0214678 | A1 | 9/2007 | Son et al. | |
| 2009/0025250 | A1 | 1/2009 | Koo et al. | |
| 2010/0263226 | A1 * | 10/2010 | Balerdi Azpilicueta et al. | 34/475 |

* cited by examiner

*Primary Examiner* — Kenneth B Rinehart
*Assistant Examiner* — Tiffany Johnson
(74) *Attorney, Agent, or Firm* — Clifton G. Green; McGarry Bair PC

(57) ABSTRACT

A method for determining an empty load in a clothes dryer having a drying chamber with an air inlet, an air outlet and operable according to a predetermined cycle of operation.

20 Claims, 9 Drawing Sheets

METHOD TO DETECT AN EMPTY LOAD IN A CLOTHES DRYER

BACKGROUND OF THE INVENTION

Clothes dryers may have means to detect an empty load and end a drying cycle based upon such detection. Such detection may be conducted with the use of various sensors, such as humidity sensors and temperature sensors. By making a quick detection, energy consumption in the clothes dryer could be reduced. Additionally, a quick detection of an empty load condition may allow the dryer to be available to run a useful cycle of operation rather than operating on an empty load. On the other hand, a false detection of an empty load may result in incomplete drying of clothes.

SUMMARY OF THE INVENTION

One embodiment of the invention is related to a method for determining an empty load in a clothes dryer having a drying chamber with an air inlet and an air outlet, and operable according to a predetermined cycle of operation. Air may be supplied through the drying chamber by introducing air into the air inlet and exhausting air from the air outlet. The air may be selectively heated such that the outlet temperature of the air repeatedly cycles between an upper temperature limit and a lower temperature limit threshold and repeatedly determining a local minimum temperature of the inlet air. An inlet temperature difference of the local minimums may be repeatedly determined and used to determine that the drying chamber is empty when the inlet temperature difference satisfies a predetermined threshold.

DESCRIPTION OF AN EMBODIMENT OF THE INVENTION

The present invention relates generally to a clothes dryer and detecting an empty load condition. More specifically, the invention is related to detecting an empty load condition by controlling the clothes dryer outlet air temperature and monitoring the corresponding inlet air temperature.

Figure 1:
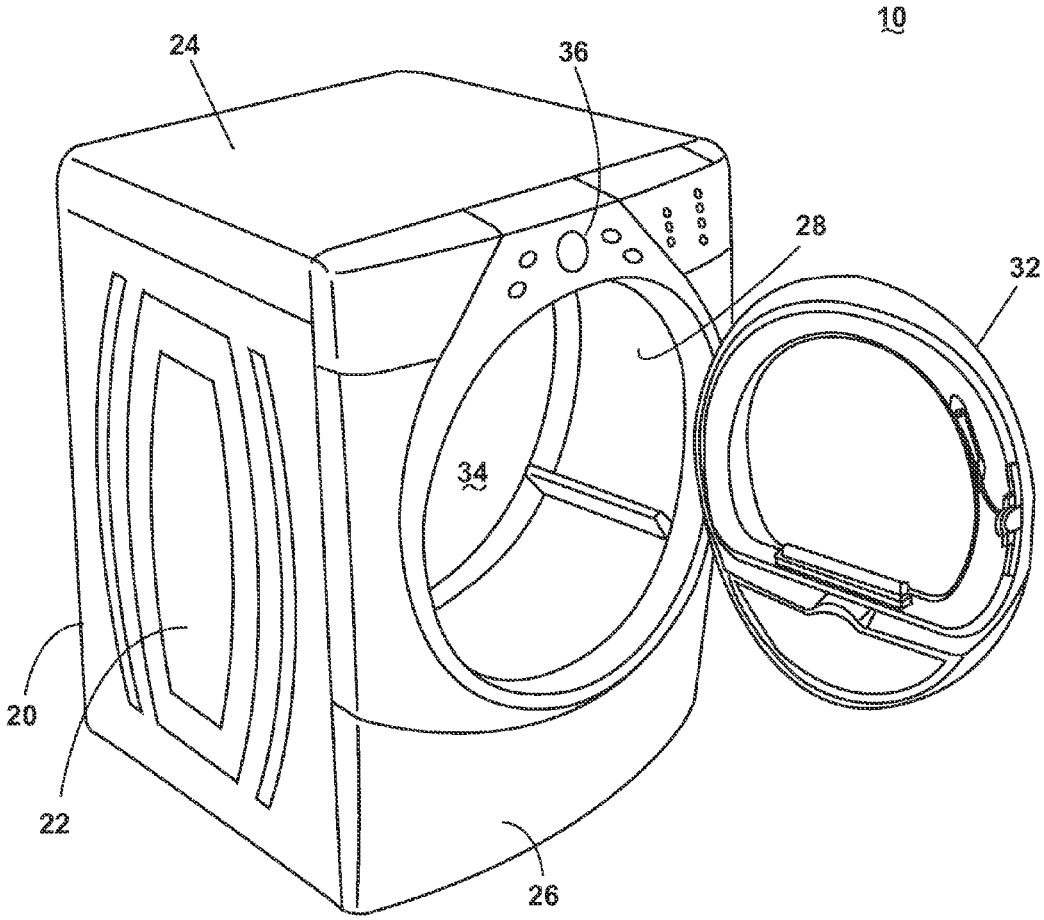
FIG. 1 is a perspective view of a clothes dryer.
Figure 2:
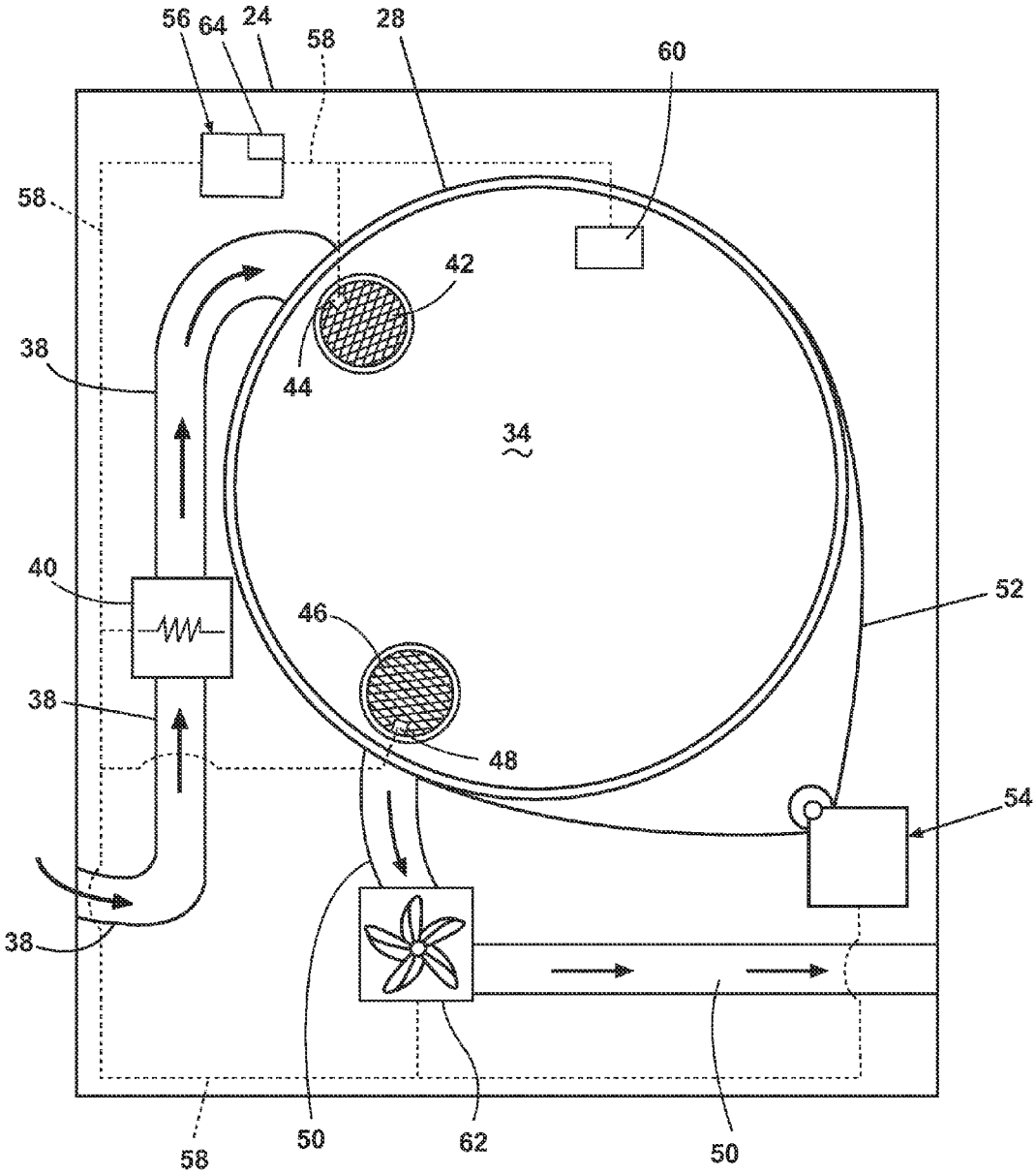
FIG. 2 is a schematic sectional view through the clothes dryer of FIG. 1 showing a drying chamber with an air inlet and an air outlet.

FIG. 1 is a schematic view of a clothes dryer 10 with a cabinet formed by panels mounted to a chassis. There is a rear panel 20, side panel 22, top panel 24, and front panel 26. There may be an opening within the front panel 26 that a door 32 selectively opens/closes. The door 32 may be opened to access a drying chamber 34, which is illustrated being formed by a drum 28, located within the interior of the cabinet. The drum 28 may be rotatable and may be rotated by a drive belt 52 connected to a motor 54 (FIG. 2). A user interface 36 may be disposed on the front housing panel 26 of the clothes dryer 10. The user interface 36 may provide for a user to select or modify a predetermined cycle of operation of the clothes dryer.

While the invention is described in the context of a clothes dryer, it is applicable to other types of laundry treating devices where drying occurs. For example, "combo" machines, which perform both a clothes washing and a clothes drying function may incorporate the invention.

FIG. 2 is a sectional view through the clothes dryer showing the drying chamber 34 defined by the drum 28 and illustrating one possible air flow system for supplying/exhausting air from the drying chamber 34. The air flow system comprises an air inlet 42 to the drying chamber 34, which is supplied air via an air inlet conduit 38, and an air outlet 46 to the drying chamber 34, which is exhausted air via an air outlet conduit 50. A heating element 40 may be provided in the inlet conduit 38 to heat the air passing through the air flow system. A blower 62 may be provided in the air outlet conduit 50 to force air thorough the air flow system. The air entering the drying chamber 34 may be selectively heated by energizing or de-energizing the heating element 40.

An air inlet temperature sensor 44 may be located in fluid communication with the air flow system to detect the air inlet temperature. The air inlet temperature sensor 44 may be located at the air inlet 42. An air outlet temperature sensor 48 may also be in fluid communication with the air flow system to detect the air outlet temperature. The air outlet temperature sensor 48 may be located at the air outlet 46. The inlet temperature sensor 42 and the outlet temperature sensor 48 may be thermistors or any other known temperature sensing device. A humidity sensor 60 for detecting the presence of moisture may be located within the drying chamber 34. The humidity sensor 60 may be based on conductivity strips for detecting wet hits of laundry upon the conductivity strips.

The various electronic components of the clothes dryer 10 including the user interface panel 36, the heating element 40, the inlet temperature sensor 44, the outlet temperature sensor 48, the humidity sensor 60, the motor 54, and the blower 62 may be communicatively coupled to a controller 56 via electrical communication lines 58. The controller 56 may be a microprocessor, microcontroller, field programmable gate array (FPGA), application specific integrated circuit (ASIC), or any other known means for electronic control of electronic components. The controller 56 may contain an electronic memory 64 for storing information from the various electronic components.

Figure 3:
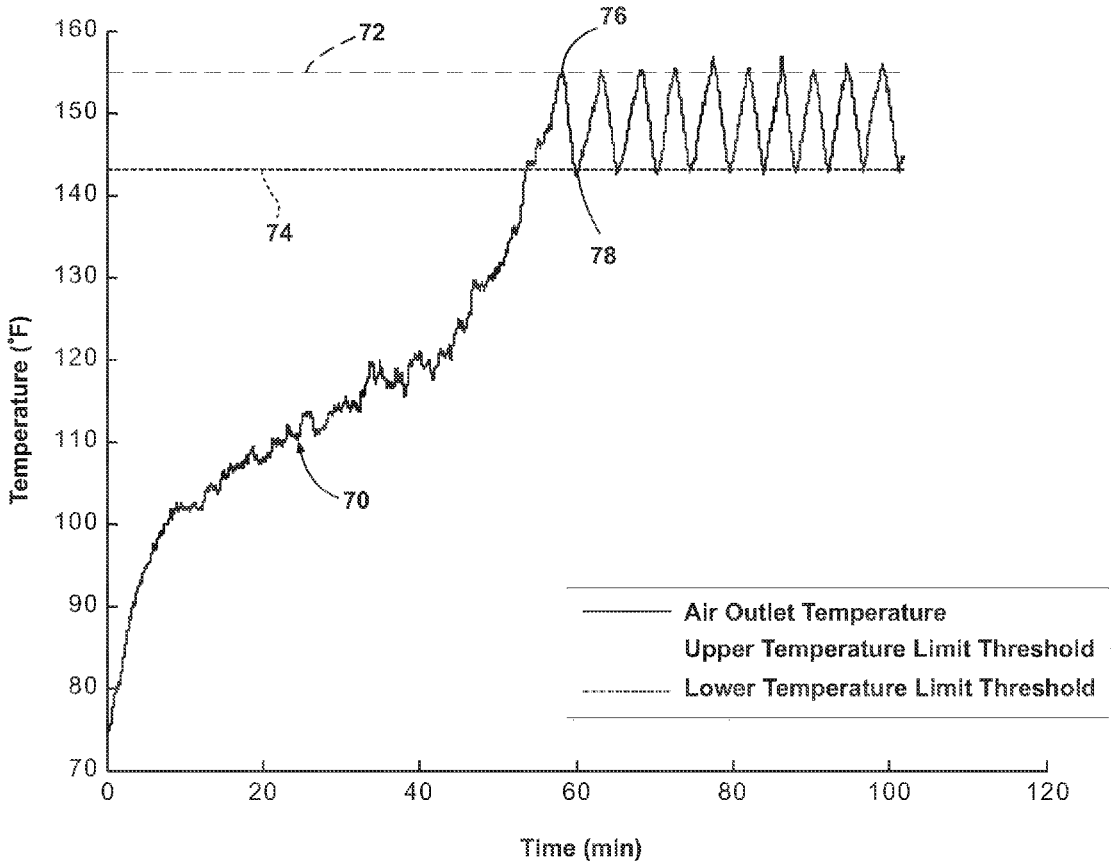
FIG. 3 is a graph of the temperature of the outlet air during a cycle of operation where the air outlet temperature is cycled between an upper and lower temperature threshold.

FIG. 3 is a graph showing time series of air outlet temperature 70 versus time in an illustrative clothes dryer cycle of operation where the air outlet temperature is cycled between an upper and lower temperature threshold. In this example, the clothes dryer 10 contains a 12 pound (lbs) mixed material load. The air outlet temperature is measured by the outlet temperature sensor 48 within the air outlet 46. The air outlet temperature may rise throughout the beginning of the drying cycle of operation while the clothes contained within the drum 28 heat up. At a certain point, the air outlet temperature 70 may rise to an upper temperature limit threshold 72, at which point the controller 56 may de-energize, or trip, the heating element 40, so that the air outlet temperature 70 does not rise any further. At or near the point where the heating element 40 is de-energized, the air outlet temperature 70 may be at a local maximum outlet temperature 76. Typically, this maximum outlet temperature 76 may be at or near the upper temperature limit threshold 72. Once the heating element 40 is de-energized to not heat the incoming air into the chamber, the air outlet temperature 70 may decrease till it reaches a lower temperature limit threshold 74, at which point the controller 56 may energize, or reset, the heating element 40 again to effect a rise in the air outlet temperature 70. At or near the point when the heating element 40 is reset again from an off state, the air outlet temperature 70 may be at a local minimum outlet temperature 78 which may be at or near the lower temperature limit threshold 74. The controller may continue to selectively heat the air into the air inlet 42 such that the air outlet temperature repeatedly cycles between an upper temperature limit 72 and lower temperature limit threshold 74 as shown in FIG. 3 during the remainder of the time in the cycle of operation. Selectively heating the air into the air inlet 42 may result in a time series of air outlet temperatures 70 that appear to fluctuate sinusoidally. If the rates of heating and cooling of the air outlet temperature are asymmetric, it might take longer for the air outlet temperature to reach one of either the upper temperature limit threshold 72 or the lower temperature limit threshold 74 form the prior extrema, relative to the other.

Figure 4:
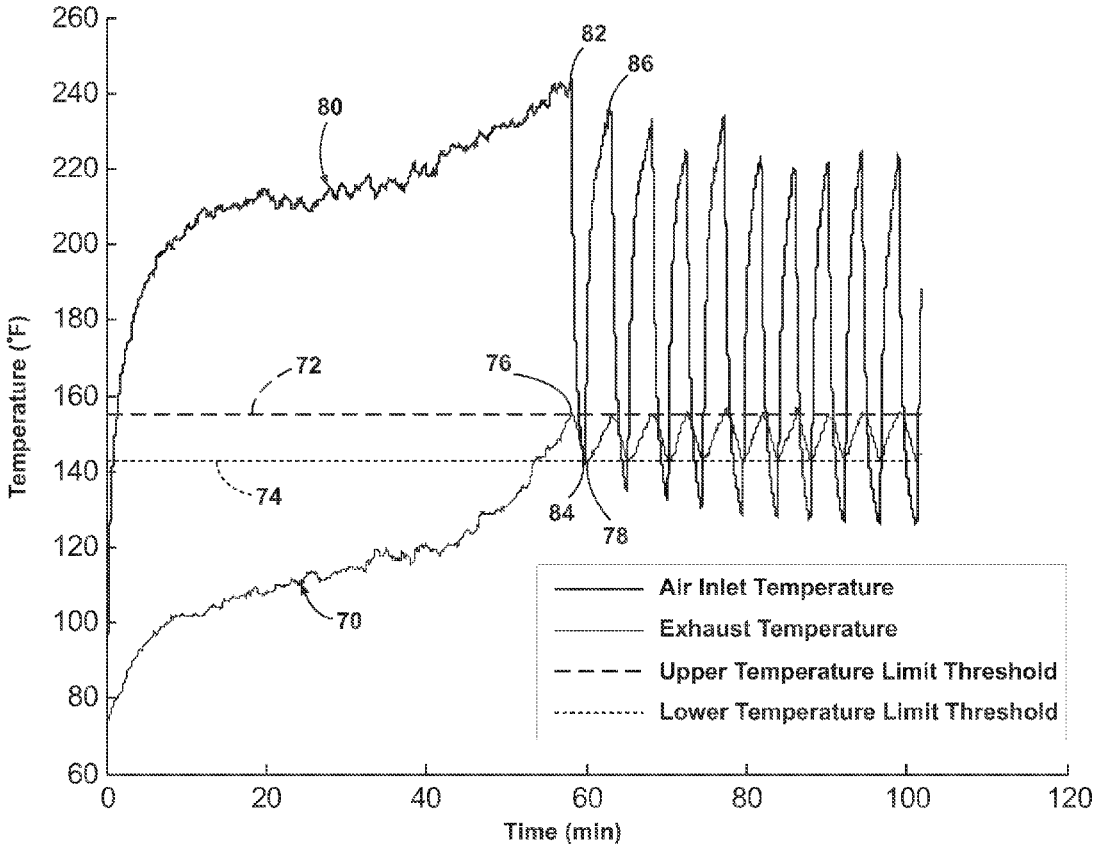
FIG. 4 is a graph of the corresponding air inlet temperature superimposed upon the cycling air outlet temperature of FIG. 3.

The air inlet temperature 80 may be monitored while the air outlet temperature is repeatedly cycled between an upper temperature limit 72 and lower temperature limit threshold 74. FIG. 4 is a graph showing the time series of air outlet temperature 70 from FIG. 3 overlayed with a time series of air inlet temperature 80. Near the beginning of the dryer cycle of operation, the air inlet temperature 80 may increase substantially monotonically until the controller 56 de-energizes, or trips, the heating element 40 as the air outlet temperature reaches the upper temperature limit threshold 72. At or near that time, the air inlet temperature reaches a local maximum 82. As the heating element 40 remains turned off during the duration between the air outlet temperature 70 reaching the upper temperature limit threshold 72 and reaching the lower temperature limit threshold 74, the air inlet temperature 80 may continue to decline, until approximately the time when the heating element 40 is re-energized, or reset, by the controller 56, as a result of the outlet air temperature 70 reaching the lower temperature limit threshold 74. At or near that time, the air inlet temperature 80 may reach a local minimum 84 and from that point start increasing till it reaches another local maximum 86, at or near the time when the controller 56 again de-energizes, or trips, the heating element 40 as a result of the air outlet temperature 70 reaching the upper temperature limit threshold 72. In this manner, the air inlet temperature may fluctuate between extrema consisting of local maxima and local minima for the duration of the clothes dryer 10 cycle of operation. Like the air outlet temperature 70, the air inlet temperature 80 may also have a substantially sinusoidal shape. Unlike the air outlet temperature 70, however, the local maxima 82 and 86 may generally decrease with the progression of time and the local minima 78 may generally decrease with the progression of time.

Figure 5:
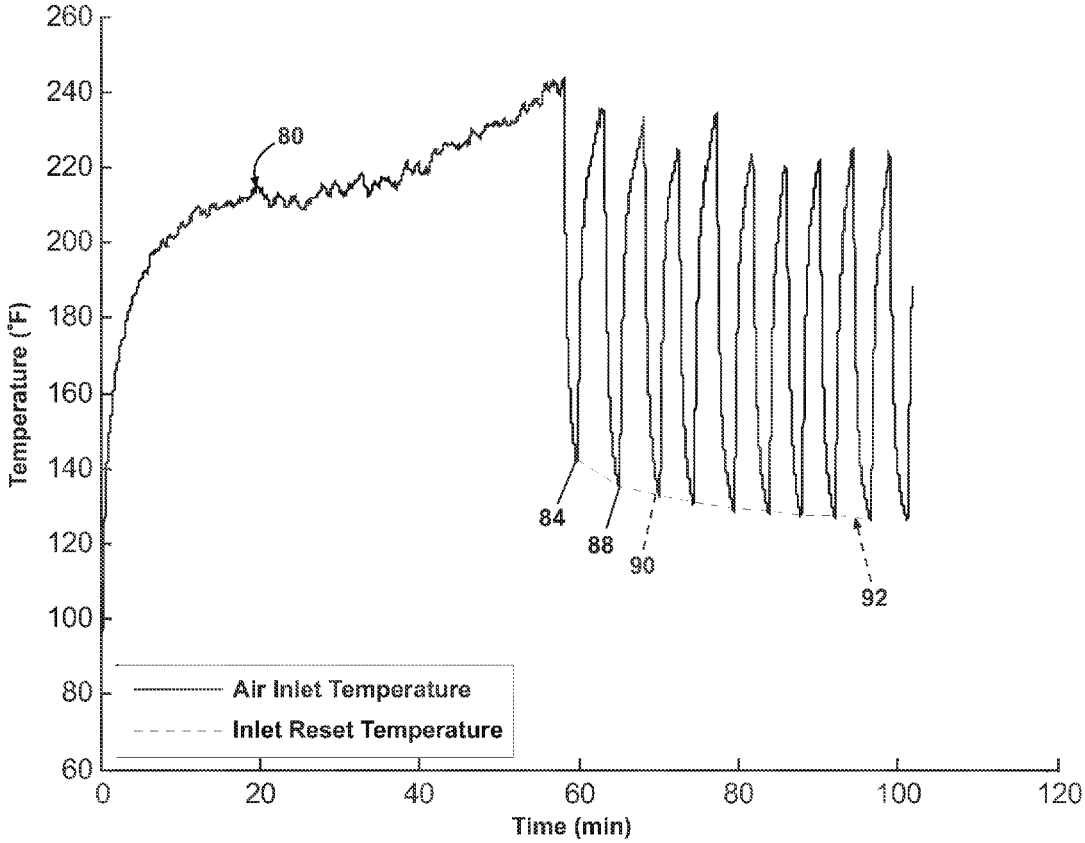
FIG. 5 is a graph of the inlet temperature of FIG. 4 without the corresponding air outlet temperature, and with an air inlet reset temperature superimposed upon the air inlet temperature.

The decrease in each of the extrema may be due to drying of moisture within the drying chamber 34 as is best explained with reference to FIG. 5, which shows the time series of air inlet temperature 80 versus time from FIG. 4, superimposed with a time series of inlet reset temperature (IRT) 92, derived from connecting and interpolating between the series of local minima 84, 88, and 90 of the air inlet temperature 80. The IRT 92 defines the lower envelope of the time series of air inlet temperature 80. As discussed in conjunction with FIG. 4, the series of local minima may decrease, resulting in the time series of (IRT) 92 having a negative slope (negative first derivative) and upward concavity (positive second derivative). The negative slope of the IRT 92 may be explained by the following equation:

$$\text{Inlet_Temp} - \text{Outlet_Temp_} = k_1\left(\frac{dM(t)}{dt}\right) + k_2(\text{Outlet_Temp} - T_{amb})$$

Where, Inlet_Temp is the air inlet temperature 80,

Outlet_Temp is the air outlet temperature 70,

M(t) is the moisture content of the clothes in the drying cavity 34 as a function of time, $T_{amb}$ is the ambient temperature outside of the clothes dryer 10, $k_1$ is a first constant, $k_2$ is a second constant.

$$\frac{dM(t)}{dt}$$

is the rate of change in the moisture content of the clothes in the drying cavity 34.

It can be seen from the previous equation that as the moisture in the drying chamber 34 decrease with time and therefore, the rate of change in the moisture content $$\left(\frac{dM(t)}{dt}\right)$$

approaches zero, the difference between the air inlet temperature 80 and air outlet temperature 70 converges. As the air outlet temperature 70 is controlled between a range of the upper temperature limit threshold and lower temperature limit threshold, the average air inlet temperature 80 must decrease to converge with the air outlet temperature 70 as moisture is removed from the drying chamber. As the local minima, local maxima, and the average of the air inlet temperature trend similarly, the local minima and as a result the IRT 92 correspondingly trends down.

As moisture is driven out of the drying chamber 34, the change in consecutive IRT 92 decreases. In practice, with a clothes load in the drying chamber, the moisture is normally highest at the beginning of the cycle. When the air inlet temperature initially begins cycling in response to the cycling of the heater, the difference between consecutive local minima 84, 88, and 90 will initially be greater than later in the drying cycle. As moisture is driven out of the chamber 34, the difference between local minima 92 will decrease significantly. In the case of an empty drying chamber, the difference will trend to zero very quickly, much more quickly than with a clothes load in the drying chamber because of the lack of moisture and clothes mass for the heated air to work on. Therefore, monitoring the difference between consecutive IRT 92 points and comparing to a predetermined threshold may indicate an empty drum condition.

An inlet reset temperature delta (IRTD) may be calculated to determine the difference between consecutive IRT points according to the following equation:

$$IRTD[n]=IRT[n-1]-IRT[n]$$

Where IRT is the inlet reset temperature,

IRTD is inlet reset temperature delta, n represents the present time segment, n−1 represents the prior time segment, Where a segment is the block of time between subsequent consecutive heating element reset events.

The IRTD value may be compared to a pre-determined threshold value to determine an empty load condition. An empty drum determination may be made if the IRTD value of the most recent segment is less than the predetermined value. The predetermined threshold value may be zero, in which case a negative IRTD value may trigger the determination of an empty drum condition. As an alternative, the predetermined threshold value may be a small positive number.

Figure 6A:
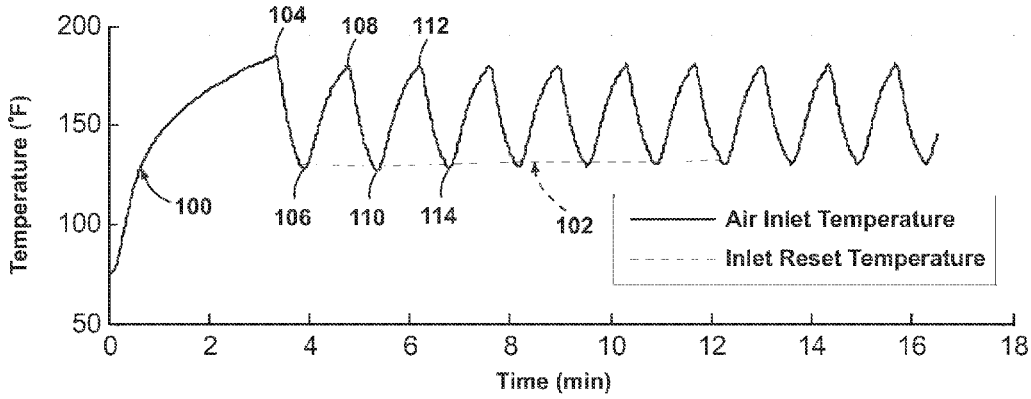
FIG. 6A is a graph of the air inlet temperature and inlet reset temperature for an empty load condition.

FIG. 6A is a graph of the air inlet temperature 100 and IRT 102 and FIG. 6(*b*) is a graph of the corresponding IRTD 116 for an empty load condition. Compared to the non-empty load condition as shown in FIG. 5, the air inlet temperature 100 rises to a first local maximum 104 much sooner. This first local maximum 104 corresponds to the air outlet temperature reaching the upper temperature limit threshold (not shown). At or near the point where the air inlet temperature 100 reaches the first local maximum 104, the heating element is tripped and the air inlet temperature 100 decreases until it reaches the first local minimum 106. This first local minimum 106 corresponds to the air outlet temperature reaching the lower temperature limit threshold (not shown).

At or near the point where the air inlet temperature 100 reaches the first local minimum 106, the heating element is reset and the air inlet temperature increases until it reaches a second local maximum 108. Also at the air inlet temperature first local minimum point 106, the air outlet temperature is found to be less than or equal to the lower temperature limit threshold, and as a result the current air inlet temperature is recorded as the first local minimum 106 in the air inlet temperature 100. Once the air inlet temperature is recorded, such as by storing in the electronic memory 64 associated with the controller 56, the air outlet temperature reset count is incremented. In the case of the first local minimum 106 corresponding to the first reset of the heating element 40, the air outlet reset count is 1. The IRTD is calculated only if the air outlet temperature reset count is 2 or greater. In this case of the first reset corresponding to the first local minimum 106 of the air inlet temperature 100, where it is determined if air outlet temperature reset count is greater or equal to 2 yields an answer of 'No' and as a result, the IRTD 116 is not calculated in this first reset event. The IRTD during this first portion 118 is set at zero. This first segment of time before the second heating element 40 reset corresponds to n=0, where IRTD (0)= 0. In other words, until the air outlet temperature reset count reaches 2, the IRTD 118 is zero. The air outlet temperature after the first heating element trip continues to be monitored.

When the heating element 40 is reset for the first time and the air outlet temperature rises again to the upper temperature limit threshold (not shown) the heating element is tripped by the controller 56 for the second time at or near the time of the second local maximum 108 of the air inlet temperature 100, at which point the air inlet temperature 100 decreases until it reaches the second air inlet local minimum 110. The second air inlet local minimum 110 corresponds to the air outlet temperature (not shown) being at less than or equal to the lower temperature limit threshold and resulting in a recordation of the current air inlet temperature, which is the temperature at the second local minimum 110. At this point, the heating element 40 is reset for a second time during the current cycle of operation, resulting in an air outlet temperature reset count of 2, prompting a calculation of the IRTD. The IRTD during the segment of time, n=1, from the second heating element 40 reset to the third heating element 40 reset is represented as the IRTD(1) segment 120. The IRTD(1) value is a positive number because the IRT(0) value corresponding to the first local minimum point 106 is a greater value than IRT(1) corresponding to the second local minimum point 110 in this case.

Figure 6B:
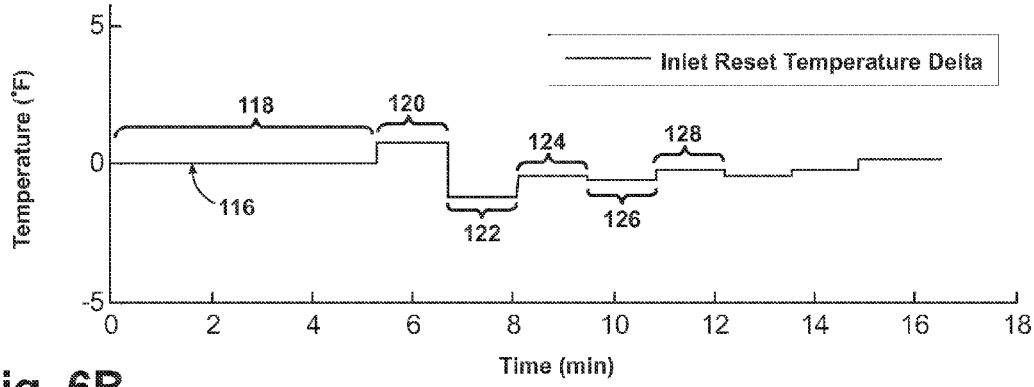
FIG. 6B is a graph of inlet reset temperature delta corresponding to the air inlet temperature and inlet reset temperature of FIG. 6(*a*) for an empty load condition.

Continuing with FIG. 6B, as the air inlet temperature fluctuates between the maxima 104, 108, and 112 and minima 106, 110, and 114, the temperature at the minima is recorded and is used to construct the time series of IRT 102. The time series of IRTD 116 may also be continuously calculated until the end of the clothes dryer 10 cycle of operation. The IRTD 116 is shown as segments 118, 120, 122, 124, 126, 128 corresponding to segments of time between heating element 40 reset events. IRTD(0) 118, corresponding to the first segment before the second heating element 40 reset event may be a longer period of time compared to subsequent segments of IRTD(1) 120, IRTD(2) 122, IRTD(3) 124, IRTD(4) 126 and IRTD(5) 128. Depending on the value of the IRTD predetermined threshold, the empty load may be detected. For example, if the IRTD predetermined threshold is zero, then the empty load may be detected at segment IRTD(2) segment 122. This may result in the empty load detection near the beginning of the segment 122 at around a time of 6.5 minutes into the clothes dryer 10 cycle of operation. If the empty load is detected at that point, then the clothes dryer 10 cycle of operation may be stopped, with no subsequent data collection.

Figure 7A:
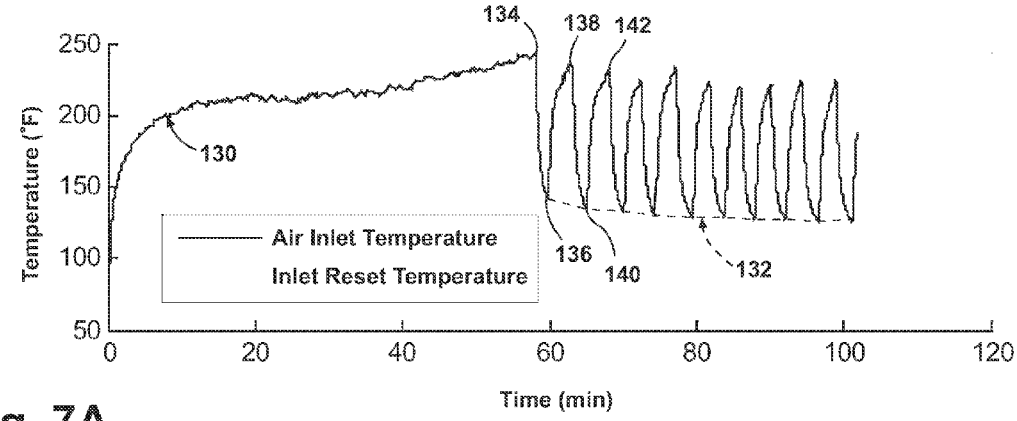
FIG. 7A is a graph of the air inlet temperature and inlet reset temperature for a non-empty load.
Figure 7B:
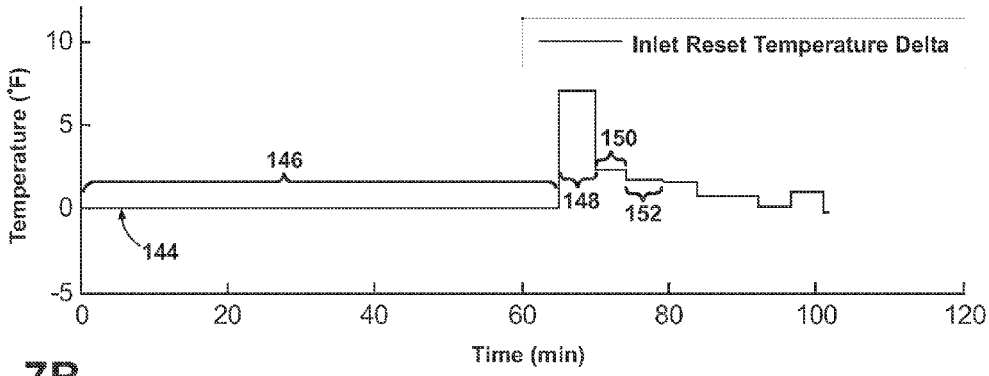
FIG. 7B is a graph of inlet reset temperature delta corresponding to the air inlet temperature and inlet reset temperature of FIG. 7A for a non-empty load.

FIG. 7A is a graph of the air inlet temperature 130 and IRT 132 and FIG. 7B is a graph with the corresponding IRTD 144 for a non-empty load condition. The first air inlet temperature local maximum 134 is at a much longer time of approximately 57 minutes after the start of the clothes dryer 10 cycle of operation when compared to the empty load condition shown in FIGS. 6A and 6B. Like in the empty load case, with the non-empty load case, the air inlet temperature may make a sequence of local maxima 134, 138, and 142 and minima 136 and 140. The collection of local minima 136 and 140 may be used to generate the time series of IRT 132. The IRT 132 can be used to determine the time series of IRTD 144. Like in the case of the empty load condition, the IRTD 144 may have unique values for each of the segments 148, 150, and 152, where a segment is the period of time between consecutive local minima.

Figure 8:
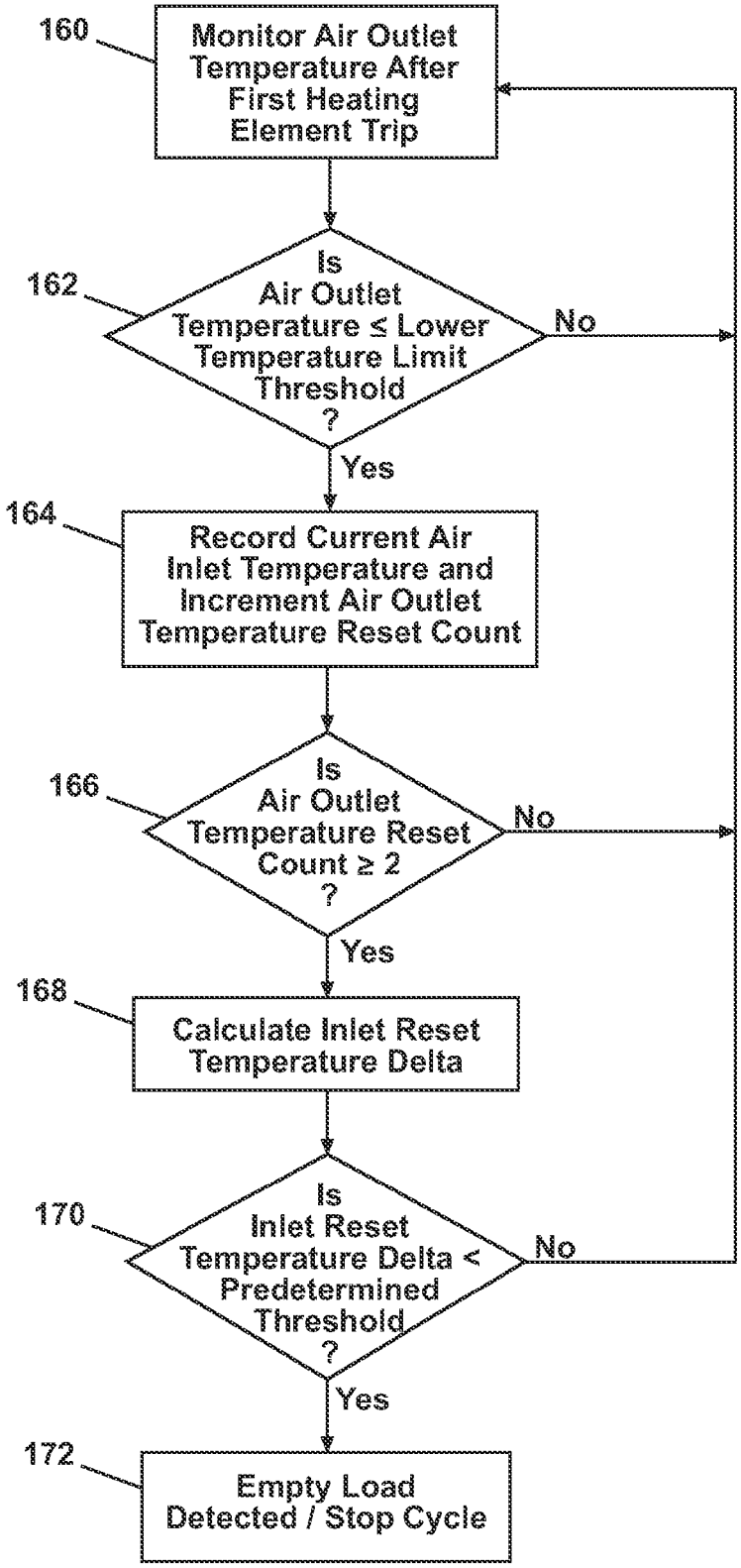
FIG. 8 is a flow chart depicting one embodiment of the present invention for determining an empty drum condition.

FIG. 8 is a flow chart depicting one embodiment of the present invention where an empty drum condition may be detected based on the inlet reset temperature corresponding to selectively heating the air coming in to the drying chamber as described in conjunction with FIGS. 3-7. The first step is to repeatedly monitor the air outlet temperature after the first heating element trip 160 to determine if the air outlet temperature is less than or equal to the lower temperature limit threshold 162. If the air outlet temperature is not at or below the lower temperature limit threshold, then the method keeps monitoring the air outlet temperature after the first heating element trip 160. If on the other hand, the air outlet temperature is less than or equal to the lower temperature limit threshold, then the current air inlet temperature will be recorded and the air outlet temperature reset count is incremented 164. The air outlet temperature reset count is reset to zero prior to each dryer cycle of operation, such that after the first heating element reset, the air outlet temperature reset count is incremented to 1. The recording of the current air inlet temperature may be accomplished by storing the current air inlet temperature value in the electronic memory 64 associated with the controller 56. The temperature recorded at this step can be considered the local minima at the air inlet temperature 80 and is one data point in the IRT 92. Next it will be determined if the air outlet temperature reset count is two or greater 166. If the count is less than two then the air outlet temperature will continue to be monitored. If the air outlet temperature reset count is greater than two, meaning the heating element 40 has been reset, or turned on twice due to the air outlet temperature 70 reaching the lower outlet temperature threshold, and thereby generating two or more local minima for the air inlet temperature, then the IRTD is calculated 168.

Next it will be determined if the IRTD is below a predetermined threshold 170. If it is not below a predetermined threshold, then an empty drum has not been detected and the method starts from the beginning by monitoring the air outlet temperature 160. If the method is restarted, then the local minimum of the air inlet temperature is repeatedly determined and a new IRTD is repeatedly calculated for each time segment and compared to the predetermined threshold. If the IRTD is below the predetermined threshold, then an empty load is declared and the cycle of operation is stopped 172. In some instances the pre-determined threshold may be a 0, such that if a negative IRTD is calculated, then the empty load is detected. In other cases the IRTD may be a small positive number.

Figure 9:
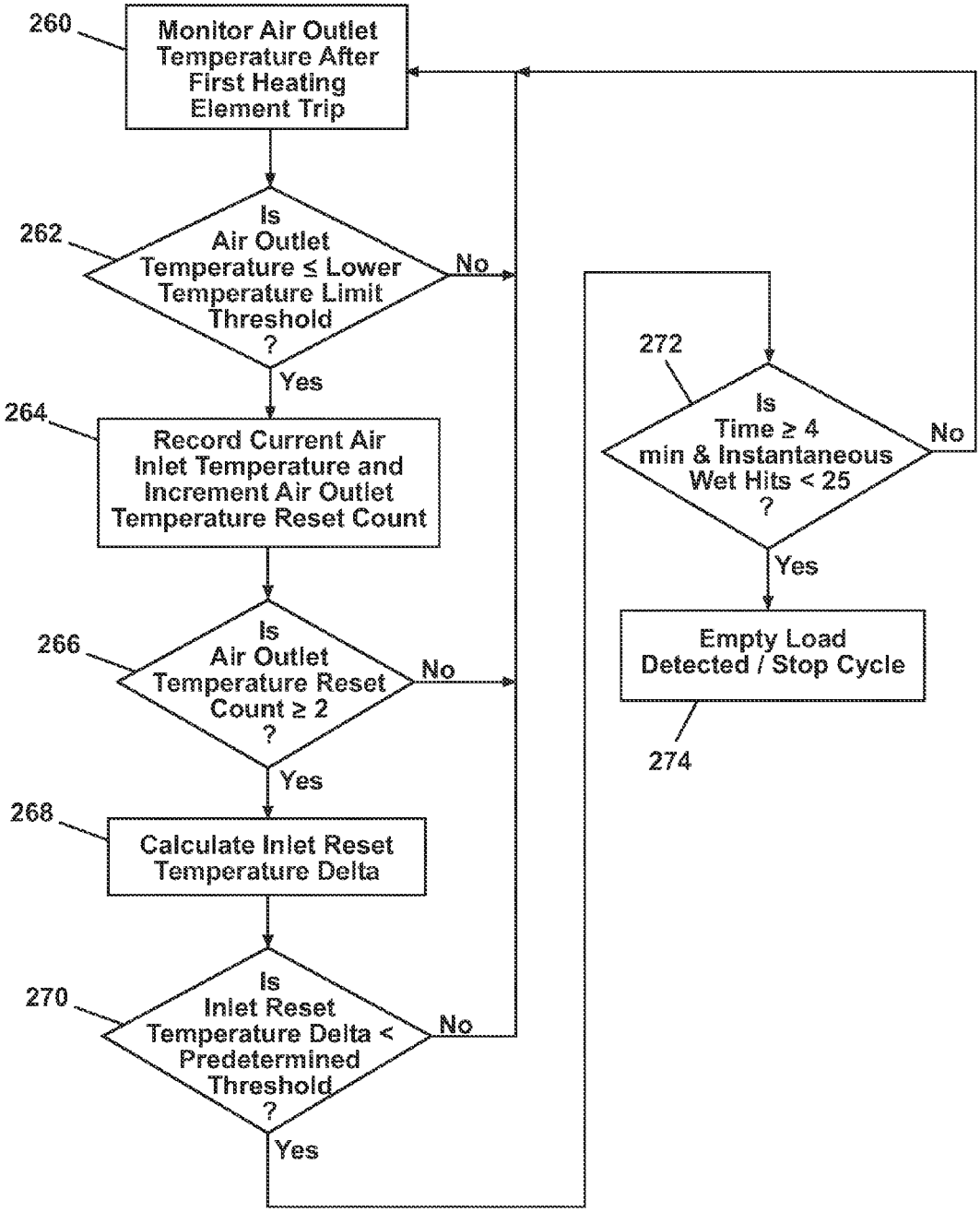
FIG. 9 is a flow chart depicting another embodiment of the present invention for determining an empty drum condition.

FIG. 9 is a flow chart depicting another embodiment for determining if the drying chamber 34 is empty. Like the first embodiment, the air outlet temperature is monitored after the first heating element trip 260 to determine if the outlet temperature is less than or equal to the lower temperature limit threshold 262. If the air outlet temperature is not less than or equal to the lower temperature limit threshold, then the air outlet temperature continues to be monitored 260. If the air outlet temperature is less than the lower temperature limit threshold, then the current air inlet temperature is recorded and the air outlet temperature reset count is incremented 264, such as by storing the air inlet temperature value in an electronic memory associated with the controller 56. The stored air inlet temperature may be a local minima of the air inlet temperature corresponding to a heating element reset based upon the air outlet temperature reaching the lower temperature limit threshold. Next it is determined if the air outlet temperature reset count is at least 2. If it is not, then the air outlet temperature continues to be monitored 260. If the air outlet temperature count is at least 2, then the IRTD is calculated 268 by the means described in conjunction with FIG. 6. Next it is determined if the IRTD is less than a predetermined threshold 270. If it is not, then the air outlet temperature continues to be monitored 260. If, however, the IRTD is less than a predetermined threshold, then it is determined if the time in to the cycle is greater than or equal to 4 minutes and if the instantaneous wet hits from the humidity sensor 60 is less than 25 272. If it is not, then the air outlet temperature continues to be monitored 260. If, however, both conditions of time in to the cycle of operation are greater than or equal to 4, and wet hits of less than 25 are satisfied, then and empty load condition may be declared and the clothes dryer 10 cycle of operation may be stopped 274.

The additional step of determining that the time in to the cycle of operation is at least 4 minutes and that the instantaneous wet hits is less than 25 272, is to add greater robustness to the determination of an empty load 274 as compared to the method depicted in FIG. 8. In particular the additional step 272 may reduce the probability of falsely declaring an empty load.

In the beginning of the clothes dryer 10 cycle of operation, for example during the first 4 minutes, there may be additional noise that is not present during the remainder of the cycle of operation. This noise may provide for noisy IRT data that may lead to artificially low IRTD calculations, resulting in false declaration of an empty drum. The noise is especially problematic when trying to discriminate between a small load such as a single pair of socks and a truly empty load. Some of the noise during the beginning of the clothes dryer 10 cycle of operation may result from excess moisture evaporating from the drum 28 of the dryer. The dryer drum may be constructed from metal or ceramic materials with a low specific heat compared to the clothes within the drum 28. As a result, the dryer drum may heat up faster than the clothes and may lead to the evaporation of the excess moisture that may be on the drum surface, not in the clothes. As this moisture is evaporating, with a consumption of thermal energy from the heating element 40 being used to evaporate excess moisture near the beginning of the clothes dryer cycle, the air inlet temperature may not be as high as it would otherwise be without the excess moisture on the drum 28 surface. As a result, the first few IRT points corresponding to times when there is excess moisture on the drum surface may be low and then the IRT may rise when moisture is primarily in the clothes within the drum and not on the drum surface itself. During the transition from a low IRT to a high IRT, corresponding to evaporation of humidity from the drum surface, there may be low IRTD values generated, that may result in a false early declaration of an empty drum. Therefore, not allowing empty drum declaration near the beginning of the cycle, such as during the first 4 minutes, of operation may provide for more robust detection of empty drum, and fewer false detection. Although, an empty drum declaration exclusion time of 4 minutes is discussed in the forgoing discussion, the empty drum declaration exclusion time could be any quantum of time at the beginning of the cycle of operation. Additionally, the empty drum declaration exclusion time may be different for different types and sizes of dryers and even for different cycles of operation. For example, a delicates cycle of operation may have a certain empty drum declaration time and a wrinkle free cycle of operation may have a different empty drum declaration exclusion time.

Continuing on with the discussion of step 272, the instantaneous wet hits provides a means of determining the conductivity of any fabric load of the drying chamber and determining that the drying chamber is empty based upon the conductivity. The instantaneous wet hits of conductive fabric may be determined from the humidity sensor 60. Typically, if there is an empty load, there may be zero or very few wet hits detected by the humidity sensor 60. Therefore, a very low wet hits count may be a secondary indication of an empty load. When the wet hits indicator is used in conjunction with the inlet temperature difference threshold method, as described in step 272, the result may be a more error free indicator of an empty load.

In the description of the method of the inlet temperature difference method for detecting an empty load, the air inlet reset temperature, or the air inlet temperature when the heating element 40 is re-energized, corresponding to a local minimum in the air inlet temperature was used. However, as an alternative, an envelope of the time series of the air inlet temperature corresponding to either the local minimum or the local maximum may be used, where the air inlet temperature difference may be derived from the envelope corresponding to either the upper temperature limit or lower temperature limit of the air outlet temperature.

A false detection of an empty load is undesirable, as it may result in a fabric load that is not dry. As a result there may be various ways to make the algorithm more robust to noise in the air inlet temperature may be implemented. For example, to smooth out any noise methods such as determining a simple moving average (SMA) of the inlet temperature differences is and comparing to a predetermined SMA inlet temperature differences threshold may be used.

As many clothes dryers have inlet and outlet temperature sensors for controlling the drying cycle of operation, the inlet temperature difference threshold method for detecting an empty load described herein may be implemented without any additional hardware on the clothes dryer. A clothes dryer without means to detect an empty load or without the means to robustly distinguish between an empty load and a small load, such as a single shirt, may have to run a minimum amount of time to ensure that a possible small load in the drying chamber is dry. This minimum amount of time may be around 21 minutes. The benefits of the inlet temperature difference method, as described herein, may be faster detection of an empty load condition, perhaps approximately 6 minutes in to the drying cycle of operation, which results in reduced energy consumption in the clothes dryer, better energy ratings from testing laboratories, and greater availability of the clothes dryer for running a subsequent cycle of operation, instead of running a cycle of operation on an empty load.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method for determining an empty load in a clothes dryer having a drying chamber with an air inlet and an air outlet, and operable according to a predetermined cycle of operation, the method comprising:

supplying air through the drying chamber by introducing air into the air inlet and exhausting air from the air outlet;

selectively heating the air such that outlet temperature repeatedly cycles between an upper temperature limit and lower temperature limit threshold;

repeatedly determining a local minimum temperature of air entering the air inlet for the cycles;

repeatedly determining an inlet temperature difference of the local minima; and determining the drying chamber is empty when the inlet temperature difference satisfies a predetermined threshold.

2. The method of claim 1, wherein the determining the drying chamber is empty further comprises determining a conductivity of any fabric load of the drying chamber.

3. The method of claim 2, wherein the determining the drying chamber is empty occurs when the inlet temperature difference satisfies a predetermined threshold and the determined conductivity indicates no fabric load is present in the drying chamber.

4. The method of claim 1, wherein the inlet temperature difference is determined from the local minima for sequential cycles.

5. The method of claim 1, wherein the predetermined threshold is satisfied when the inlet temperature difference is less than the predetermined threshold.

6. The method of claim 5, wherein the absolute value of the predetermined threshold of the inlet temperature difference is 0° F./min.

7. The method of claim 1, further comprising, in response to the determining the drying chamber is empty, ceasing or altering at least one of: heating of the air, rotating of a drum, and the cycle of operation.

8. The method of claim 1, wherein the selectively heating the air comprises selectively actuating a heating element upstream of the inlet.

9. The method of determining an empty load in a clothes dryer of claim 1, wherein the determining the drying chamber is empty comprises determining a simple moving average (SMA) of the inlet temperature differences is determined and compared to a predetermined SMA inlet temperature differences threshold.

10. A method for determining an empty load in a clothes dryer having a drying chamber with an air inlet and an air outlet, and operable according to a predetermined cycle of operation, the method comprising:

supplying air through the drying chamber by introducing air into the air inlet and exhausting air from the air outlet;

selectively heating the air such that outlet temperature repeatedly cycles between an upper temperature limit and lower temperature limit threshold;

determining an envelope of a time series of inlet air temperatures corresponding to one of the upper temperature limit and lower temperature limit threshold;

determining a difference between points of the envelope to determine a time series of inlet temperature differences; and determining the drying chamber is empty when the inlet temperature difference satisfies a predetermined threshold.

11. The method of claim 10, wherein the points of the envelope are one of a plurality of local maxima or local minima of a time series of inlet air temperatures.

12. The method of claim 11, wherein the points are a plurality of local minima.

13. The method of claim 12, wherein the plurality of local minima are for sequential cycles.

14. The method of claim 10, wherein the determining the drying chamber is empty further comprises determining a conductivity of any fabric load of the drying chamber.

15. The method of claim 14, wherein the determining the drying chamber is empty occurs when the inlet temperature difference satisfies a predetermined threshold and the determined conductivity indicates no fabric load is present in the drying chamber.

16. The method of claim 15, wherein the predetermined threshold is satisfied when the inlet temperature difference is less than the predetermined threshold.

17. The method of claim 16, wherein the absolute value of the predetermined threshold of the inlet temperature difference is 0° F./min.

18. The method of claim 10, further comprising, in response to the determining the drying chamber is empty, ceasing or altering at least one of: heating of the air, rotating of a drum, and the cycle of operation.

19. The method of claim 10, wherein the selectively heating the air comprises selectively actuating a heating element upstream of the inlet.

20. The method of determining an empty load in a clothes dryer of claim 10, wherein the determining the drying chamber is empty comprises determining a simple moving average (SMA) of the inlet temperature differences is determined and compared to a predetermined SMA inlet temperature differences threshold.

* * * * *